United States Patent [19]

Berry

[11] Patent Number: 5,074,518

[45] Date of Patent: Dec. 24, 1991

[54] PROPORTIONAL ANNULAR B.O.P. CONTROLLER

[75] Inventor: Joe Berry, The Woodlands, Tex.

[73] Assignee: Hydratech, Houston, Tex.

[21] Appl. No.: 609,162

[22] Filed: Nov. 2, 1990

[51] Int. Cl.[5] ..... E21B 33/06

[52] U.S. Cl. ..... 251/1.1; 137/495

[58] Field of Search ..... 251/1.1, 1.2, 1.3; 137/495

[56] References Cited

U.S. PATENT DOCUMENTS

| | | | |
|---|---|---|---|
| 3,533,468 | 10/1970 | Lewis | 166/0.5 |
| 3,695,349 | 10/1972 | Murman et al. | 166/0.5 |
| 3,887,158 | 6/1975 | Polk | 251/1.1 |
| 3,889,959 | 6/1975 | Persson | 251/1.2 X |

*Primary Examiner*—John C. Fox

*Attorney, Agent, or Firm*—Mary J. Gaskin

[57] ABSTRACT

An annular blowout preventer control system which provides a closing hydraulic pressure to the preventer in proportion to the well-bore pressure with an additive offset equal to the pressure required to energize the preventer. The control system utilizes an annular-type blowout preventer, a hydraulic pressure regulator valve, a pneumatic pressure regulating valve, and necessary controls, all mounted above a standard blowout preventer assembly on a well casing during drilling operations, or on the existing well head during workover operations. The regulator valve includes a diaphragm which operates to establish the initial closing pressure needed to seal the annular blowout preventer. After activation, changes in pressure in the well bore are sensed by the hydraulic pressure regulator valve, which delivers regulated closing pressure to the annular blowout preventer. The regulated closing pressure is proportional to the pressure encountered in the well bore.

1 Claim, 6 Drawing Sheets

PROPORTIONAL ANNULAR B.O.P. CONTROLLER

BACKGROUND OF THE INVENTION

1. Field of the Invention

The present invention relates to safety apparatus for use in the drilling and workover of bore holes in the earth for the exploration and production of minerals or geothermal energy sources. Specifically, the invention relates to control method and apparatus which permit automatic application of hydraulic closing pressure in proportion to the well-bore pressures encountered, without applying excessive closing pressure.

2. Description of the Related Art

A major concern in the drilling and workover of bore holes in the earth is the containment of pressure encountered in the well bore. To prevent expensive and dangerous blowouts of gas and/or liquids, pressure-retaining mechanical devices are mounted at the top of the well-bore casing during normal drilling operations. The "blowout preventers"(B.O.P.'s) are designed to close completely on an open hole, or to close on the outer surface of a tubular member that is used in the drilling or completion of any well bore to mechanically contain the well-bore pressure in the annular space between the well-bore casing and the tubular member.

There are two types of designs for blowout preventers. One is the ram-type, which uses opposing hydraulically-driven rams mounted to move perpendicularly to the axis of the well bore. The rams are fitted with elastomeric gaskets. When actuated laterally toward the well-bore axis, the rams close around and seal to the drill pipe and to the B.O.P. housing. The other type of preventer is referred to as "annular,""spherical," or "bag type." In this design, a rubber element encircles the drill pipe. Hydraulic pressure is applied to the rubber element to force it radially inward until contact with the pipe is made. In both cases, the preventers retain the pressure in the annular space between the drill pipe and the casing.

The annular preventer is necessary for new drilling applications. These include (1) underbalanced horizontal drilling projects, in which the weight of the drilling fluids used in the well bore is not sufficient to contain the down-hole pressure; and (2) the workover of wells containing existing well-bore pressure requiring continued drilling or workover operations after the blowout preventer has closed. In these situations, the operator maintains control of the well by applying hydraulic closing pressure to the annular blowout preventer.

Under prior art, the operator has had to guess at the amount of hydraulic pressure necessary to retain the well-bore pressure. An operator ordinarily tends to overcompensate and apply more hydraulic closing pressure than is actually necessary to maintain control of the well. The excess pressure applied accelerates wear of the blowout preventer element and damages the tubular element closed in the annular preventer.

In addition, under prior art, the annular preventer could not be operated until a detectable amount of gas had been released and was present below the rig floor. Such a situation could have serious consequences if an operator with slow reaction time delayed applying hydraulic pressure to close a well.

SUMMARY OF THE INVENTION

The present invention's main objective is to provide safe control for well-bore drilling and workover operations.

The control system has been developed for application to existing designs of annular blowout preventers. The system utilizes a pneumatic diaphragm to act against the regulator valve providing the initial closing pressure required for the no well-bore pressure seal. The control system can be activated either automatically, by a gas detection system, or manually, by the drilling rig operator. In either instance, the system's regulator senses the well-bore pressure and regulates the application of hydraulic closing pressure to the annular blowout preventer.

The combination of the pneumatic diaphragm with the well-bore pressure sensor acts to provide a hydraulic closing pressure proportional to the surface well-bore pressure, with an additive offset equal to the hydraulic pressure required to initiate a seal of the annular preventer to the drill pipe.

The control system thus ensures a closing pressure in the precise amount necessary to retain the well-bore pressure.

One of the objects of the invention is to control a well safely without excessive closing pressure, which causes accelerated wear, both of the blowout preventer element and of the drill pipe or kelly drills closed in the preventer.

Another of the objects of the invention is to control a well safely by utilizing a pneumatic diaphragm to establish the initial closing pressure required to create a no well-bore pressure seal in the annular blowout preventer.

Another object of the invention is to sense the well-bore pressure and provide a closing hydraulic pressure to the annular blowout preventer proportional to the well bore pressure.

Another object of the invention is to permit an operator to quickly and safely "strip" the tool joints on drill pipe and the couplings on a tubing workover string. ("Stripping" means pulling the tubular member axially through the blowout preventer while the preventer is activated and well-bore pressure is present.) The control system automatically relieves an amount of hydraulic closing fluid equal to the increased volume of the tool joint or coupling connector that is passing through the bore of the annular blowout preventer.

Another object of the invention is to allow an operator to "strip" a wireline into a well bore containing internal pressure. The invention would reduce wear on the cable and the packer by using only the closing pressure required to contain the well-bore pressure.

Another object of the invention is to provide a control that would be useful in oil production in west Texas and other oil fields where nitrogen or natural gas injection procedures are utilized. First, gas is injected under pressure down hole. An artificial lift device such as a pump jack is used to pump the fluid from the down-hole reservoir to the surface. At the surface around the pump jack rod, a device known as a stuffing box is used to seal around the rod and divert the producing fluid below the stuffing box. However, the stuffing boxes are not designed to hold any pressure. On occasion, the well bore will lose its fluid column, allowing the injected gas pressure into the well bore, resulting in a surface blowout. After a blowout, the surface dirt generally has to be removed and replaced with new dirt. The invention can be used in conjunction with a small, commercially-available stripping B.0.P. to replace the stuffing box and prevent pressure blowouts.

Another object of the invention is to control a hydraulic pump, i.e., in cases utilizing a B.0.P. which responds to fluid pressure drop across an operation orifice requiring a constant supply of hydraulic flow fed by a constantly-operating hydraulic pump. The invention can be used to supply a hydraulic signal to the pump to control the amount of fluid delivered to the B.0.P., thus maintaining the proper pressure drop across the B.0.P. to maintain a well-bore pressure seal.

BRIEF DESCRIPTION OF THE DRAWINGS

FIG. 3 shows an empty system;

FIG. 4 illustrates the application of pneumatic pressure to the hydraulic pressure regulator to establish the initial seal;

FIG. 5 illustrates the action of well-bore pressure against the sensor piston assembly of the hydraulic pressure regulator;

FIG. 6 illustrates the decrease in well-bore pressure due to the release of pressurized fluid through the vented fluid return.

DESCRIPTION OF THE PREFERRED EMBODIMENT

Figure 1:
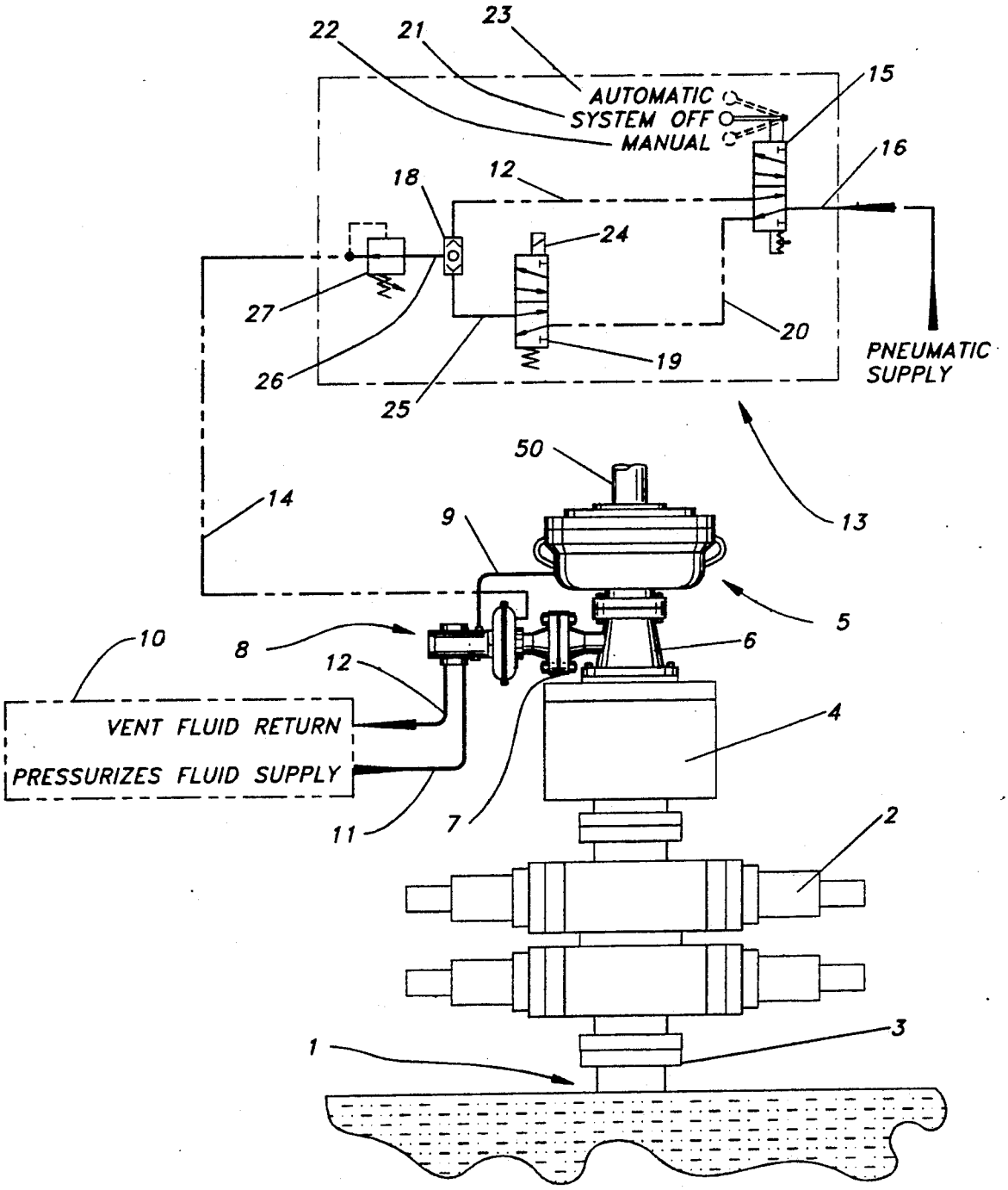
FIG. 1 is a diagrammatic view illustrating the B.O.P., the control system, and a schematic diagram of the hydraulic controls.

FIG. 1 shows operational well bore 1. A double ram-type blowout preventer 2 is mounted atop a well-bore casing 3. Mounted above the ram preventer is an annular-type blowout preventer 4. This arrangement of a ram-type preventer and an annular-type blowout preventer is typical in the drilling industry. In accordance with the invention, an additional annular preventer 5 is mounted above the commonly-used annular preventer via an adaptor spool 6. The adaptor spool has a side entry port 7 to which a hydraulic pressure regulating valve 8 is boltably attached. A fluid conducting means 9, which is connected to the hydraulic pressure regulating valve 8 and to the additional annular blowout preventer 5, conducts hydraulic fluid from the regulator valve to the blowout preventer 5. Additionally, the hydraulic pressure regulating valve 8 is connected to an external hydraulic power source 10, not a part of this invention. The hydraulic power source 10 is connected to the hydraulic pressure regulating valve 8 by flexible piping means pressurized fluid supply 11 and flexible piping means vent fluid return 12. The rig operator's control console 13 is connected to the hydraulic pressure regulating valve 8 via a flexible piping means 14. Included within the operator's control console 13 is a manually-operated directional control valve 15. The manually-operated directional control valve 15 is connected to a pneumatic power source via a piping means 16. The function of the manually operated directional control valve 15 is to direct the flow of pneumatic pressure selectively to either a shuttle valve 18 via conducting means 17 or to an electrically-actuated solenoid-operated directional control valve 19 via piping means 20. The manually-operated directional control valve 15 is a three-position, detent valve, which remains in position as determined by the operator until a change in operating conditions dictates (1) additional activation of the system; (2) transfer of control to a remote gas-detection system; or (3) transferring control to a remote control station, no part of the invention. The valve 15 completely blocks the flow of the pneumatic pressure in the center system off position 21. In the manual position 22, the manually-operated directional control valve 15 directs pneumatic pressure to the shuttle valve 18 via piping means 17. In the automatic position 23, the manually-operated directional control valve 15 directs the pneumatic pressure to the electrically-actuated solenoid-operated directional control valve 19 via a piping means 20. The pneumatic pressure is blocked at the electrically-actuated solenoid-operated directional control valve 19 until an electrical signal is applied to the solenoid 24. Application of an electrical signal to the solenoid 24 shifts the spool in the control valve 19 to direct the flow of pneumatic pressure to the shuttle valve 18 via a piping means 25. The electrical signal is received from a gas-detection system, or from some other remote means of activating the system, i.e. a remote-mounted electrical switch.

The function of the shuttle valve 18 is to receive a pneumatic pressure signal from either of two sources, directing the flow to a singular outlet port while isolating the other inlet port. The shuttle valve 18 outlet is connected via a piping means 26 to an adjustable pneumatic pressure regulator 27. The regulator is a standard design which receives pneumatic pressure at its inlet port and reduces the pressure to the set pressure at its outlet port. The set pressure is infinitely adjustable by the rig operator in response to the initial closing pressure required by the annular blowout preventer 5 to establish a no well-bore pressure seal. The pneumatic pressure regulator 27 is connected to the hydraulic pressure regulator valve 8 via a flexible piping means 14.

Figure 2:
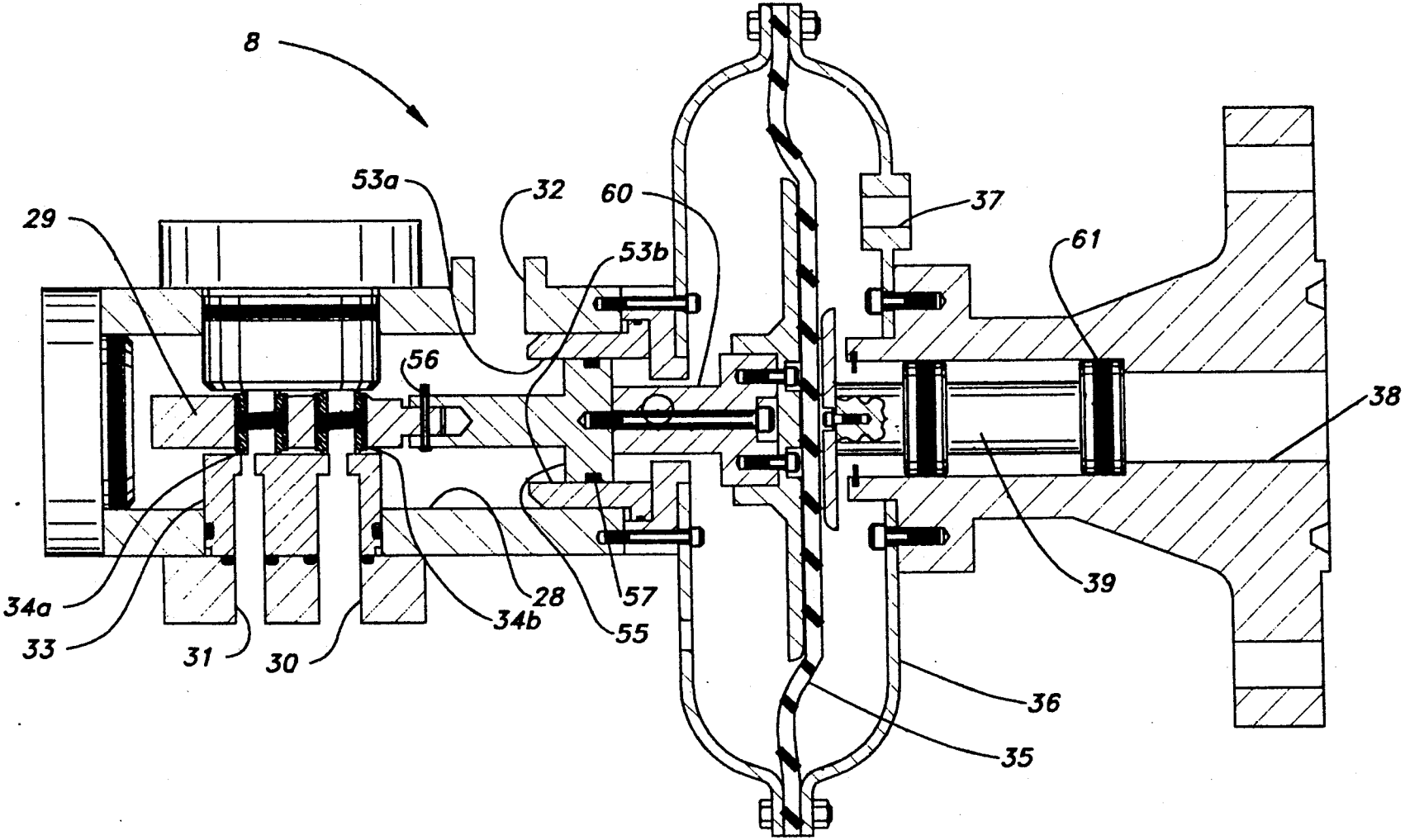
FIG. 2 is a cross-sectional view of the hydraulic pressure regulating valve.

The hydraulic pressure regulator valve 8 is illustrated in greater detail in FIG. 2. The hydraulic pressure regulator valve 8 consists of a pressure-retaining body member 28 in which resides the valve stem assembly 29. The valve stem assembly 29 is boltable and pinned 56 connected to the plunger 55. The plunger 55 is cylindrical in shape and uses an elastomeric seal 57 acting against the plunger guides 53*a* and 53*b*. The plunger 55 moves axially inside the plunger guides 53*a* and 53*b*. The hydraulic pressure-regulating valve 8 also has a pressurized fluid inlet port 30, a vent fluid return port 31, and a regulated fluid outlet port 32. The inlet port 30 delivers pressurized fluid to the distribution plate 33, which in turn presents the fluid to the valve discs 34*a* and 34*b* contained in the valve stem assembly 29. The hydraulic regulator valve 8 has a pneumatic diaphragm 35 contained inside the valve bonnet 36, which is boltably connected to the valve stem assembly 29, in a manner such that application of regulated pneumatic pressure applied to the pneumatic pressure inlet port 37 acts on the pneumatic diaphragm 35 to apply force against the diaphragm guide 60, which in turn reacts against the plunger 5 and the valve stem assembly 29. The pressure regulating action will be explained in greater detail infra. Additionally, the hydraulic pressure regulator valve 8 has a well-bore pressure inlet flange 38 which is boltably connected to the valve bonnet 36. An integral part of the well-bore pressure flange 38 is the well-bore pressure sensor piston assembly 39. The well-bore pressure sensor piston assembly 39 is movable slideably axially and is sealed to the internal walls of the well-bore pressure inlet flange 38 via an elastomeric seal 61 (i.e., an O-ring). Pressure applied through the well-bore pressure inlet flange 38 will act against the well-bore pressure sensor piston assembly 39 is such a manner as to slide the piston 39 axially, contacting the pneumatic diaphragm 35. The force exerted by the well-bore pressure against the well-bore pressure sensor piston assembly 39 acts in conjunction with the force exerted by the regulated pneumatic pressure at the inlet port 37 against the pneumatic diaphragm 35.

Figure 3:
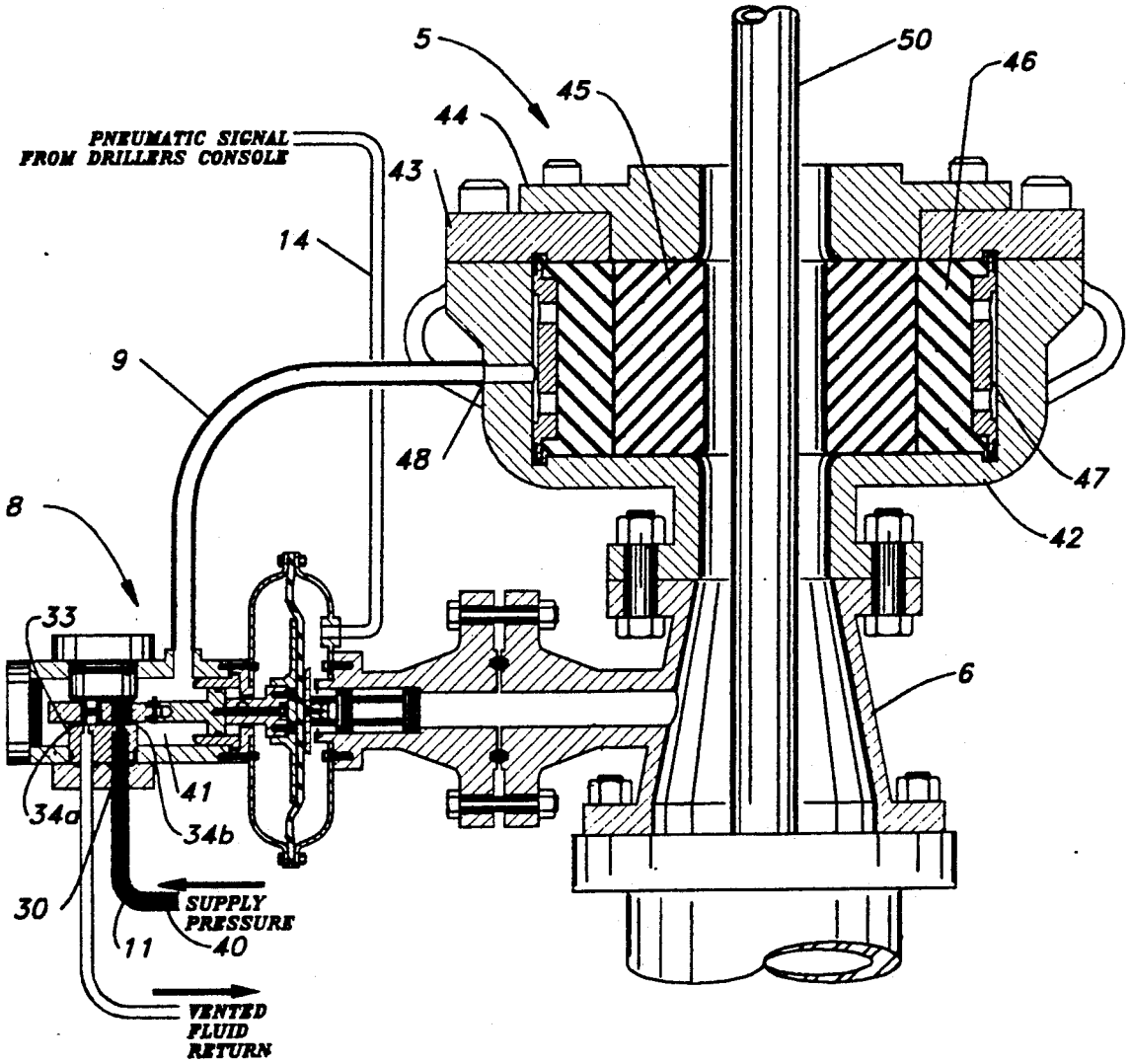
FIGS. 3 through 6 are cross-sectional views of the hydraulic regulator valve bolted to a blowout preventer assembly.

FIG. 3 is a cross-sectional view of a system consisting of the hydraulic regulator valve 8, the adaptor spool 6 and the blowout preventer 5, all boltably mounted to an acceptable blowout preventer assembly. Those knowledgeable in drilling practice will accept that the system could be boltably attached to a conventional well-head for a workover operation in which a standard blowout preventer is not present.

As illustrated, the main components of the annular blowout preventer 5 are the pressurized housing 42, the top cover 43 and the secondary top cover 44. These components are boltably connected to form the pressure-retaining housing of the annular blowout preventer 5. The internal components of the blowout preventer 5 are the elastomeric inner packer 45, the elastomeric outer packer 46 and the metallic retainer ring 47. The retainer ring 47 is a cylindrically-shaped member that retains the outer packer 46 and forms a pressure seal between the pressurized housing 42 and top cover 43. Additionally, the retainer ring 47 is diametrically undercut on its outside diameter in the middle of its axial wall, and it contains radial holes 49 through its wall thickness. The purpose of the undercutting and the radial holes 49 is to allow the pressurized closing fluid delivered from the hydraulic pressure regulating valve 8 via the inlet port 48 to act against the outside diameter of the outer packer 46.

As shown in FIG. 3, supply pressure 40 is present in piping means 11 connected to the pressurized fluid inlet port 30 of the hydraulic pressure regulator valve 8. Since the valve discs **34*a* and 34*b* are centered over the corresponding ports of the distribution plate 33, no pressurized fluid can flow into the pressurized cavity 41 of the hydraulic pressure regulating valve 8; hence no pressure is delivered to the annular blowout preventer 5**.

Figure 4:
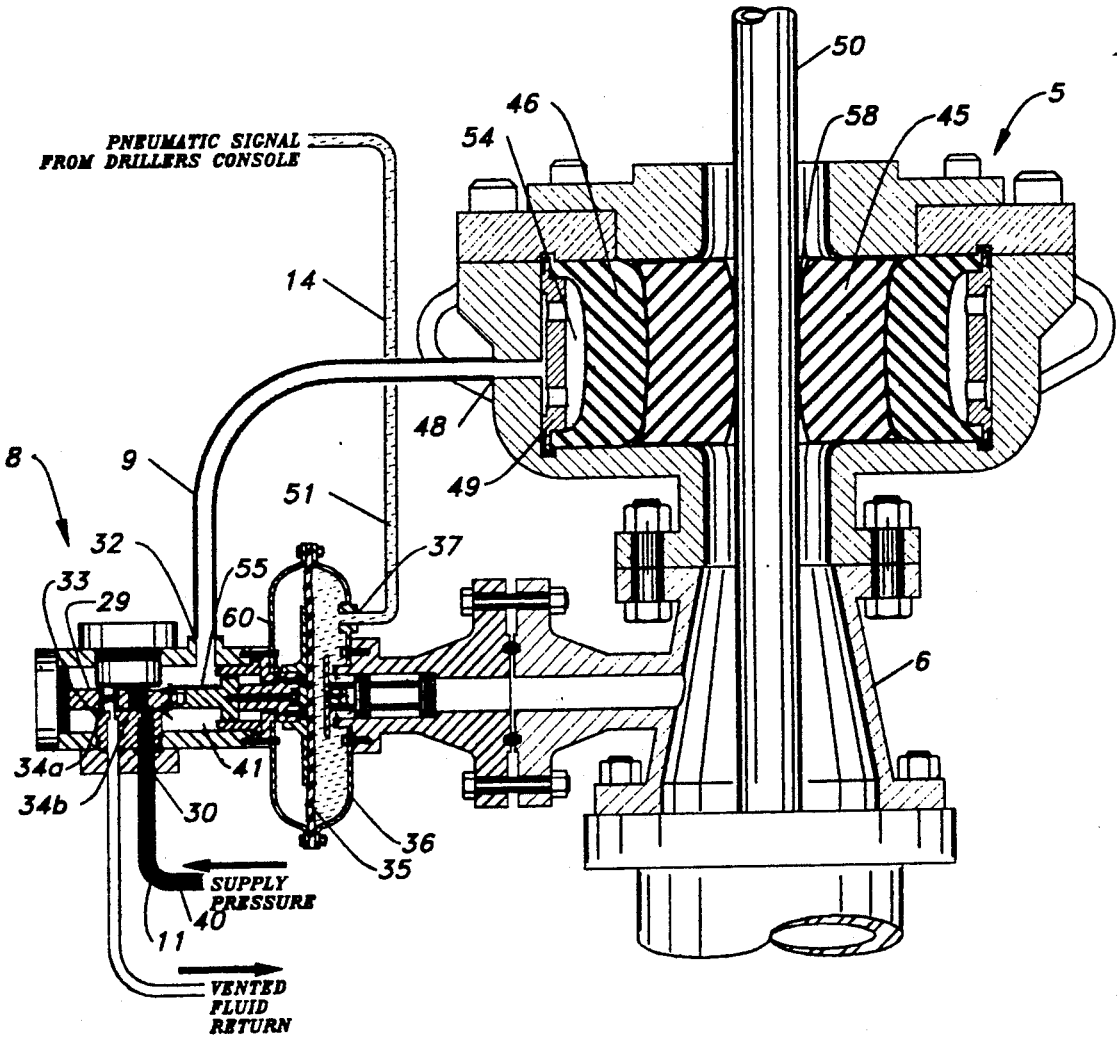

As illustrated in FIG. 4, the system has been energized by the application of regulated pneumatic pressure 51 from the operator's control console to the pneumatic pressure inlet port 37 of the hydraulic pressure regulator valve 8 via a flexible piping member 14. The pneumatic pressure 51 acts against the pneumatic diaphragm 35, which in turn acts against the diaphragm guide 60 and plunger 55, moving the valve stem assembly 29 axially away from the valve bonnet 36. The movement of the valve stem assembly 29 moves the integral valve disc **34*b* past the pressure inlet port 30 in the distributor plate 33, allowing pressurized fluid 40 present in the piping means 11 to be introduced into the internal pressure cavity 41 of the hydraulic pressure regulator valve 8 and conducted into the closing area 54 of the annular blowout preventer 5 via the piping means 9. The application of pressurized fluid against the outside diameter of the outer packer 46 causes the elastomeric outer packer 46 to move radially inward, acting against the inner packer 45, which in turn moves radially inward until it contacts the tubular member 50 to form a pressure-retaining seal 58**.

The fluid pressure in the internal cavity acts against the plunger piston 55, which is boltably joined and pinned between the valve stem assembly 29 and the pneumatic diaphragm guide 60 and pneumatic diaphragm 35. The plunger piston 55 moves axially with the valve stem assembly 29 and pneumatic diaphragm 35. When the internal pressure acting against the frontal area of the plunger piston 55 becomes greater than the force exerted by the pneumatic pressure 51 acting against the area of the pneumatic diaphragm 35, the valve stem assembly 29 is moved axially towards the valve bonnet 36, again centering the valve disc **34*b* over the pressure inlet port 30 in the distributor plate 33, stopping the pressurized fluid 40 from flowing from the inlet port 30 to the internal pressure cavity 41**.

Figure 5:
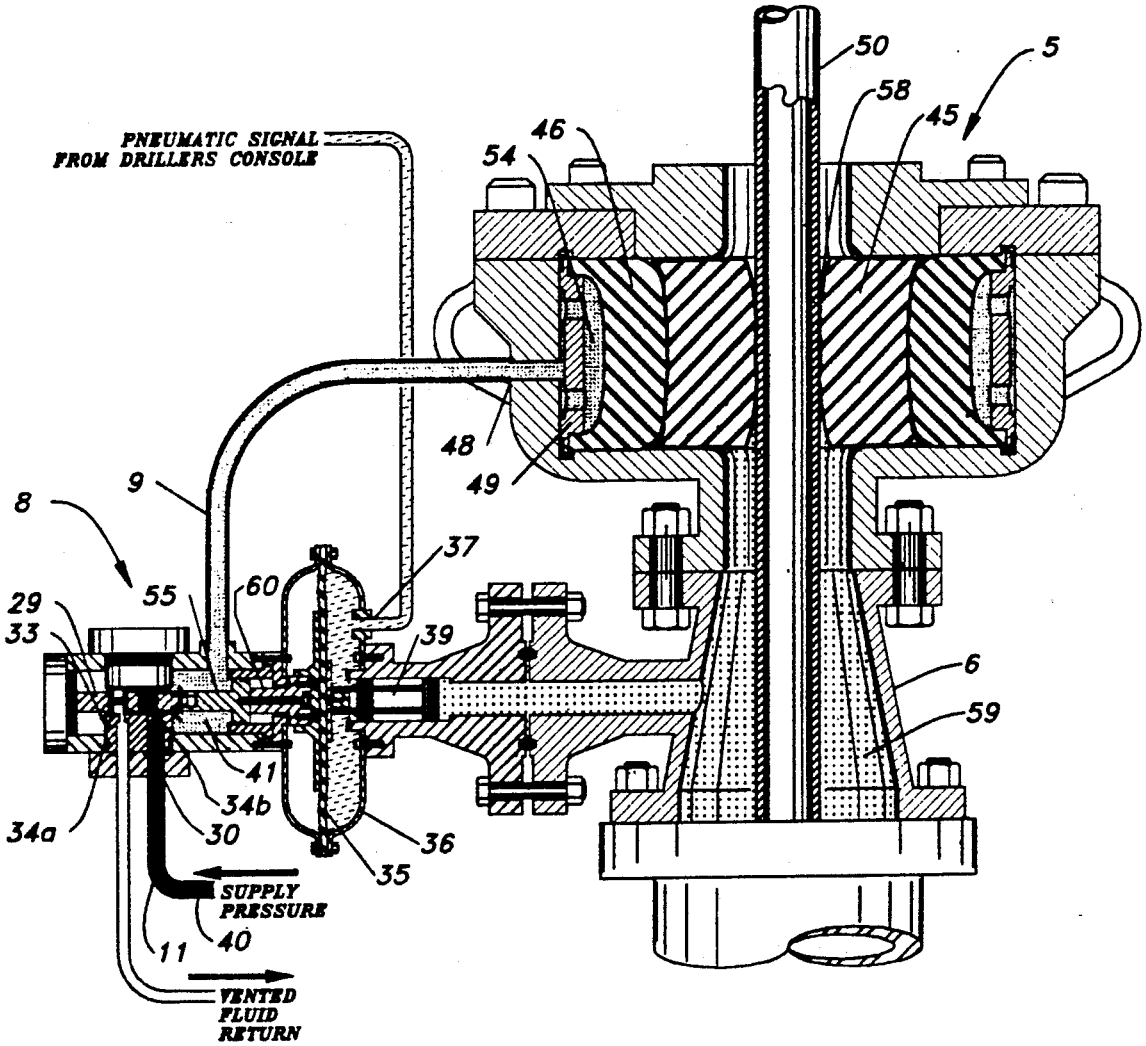

As illustrated in FIG. 5, once the initial seal 58 between the inner packer 45 of the annular blowout preventer 5 and the tubular member 50 has been established, well-bore pressure 59 in the annular space between the tubular member 50 and the adaptor spool 6 will begin to build. This well-bore pressure 59 will act against the well-bore pressure sensor piston assembly 39, which will in turn slide axially away from the adaptor spool 6 until it contacts the pneumatic diaphragm 35. As the well-bore pressure continues to build, the well-bore pressure sensor piston assembly will exert an increasing force against the pneumatic diaphragm 35, moving the assembly of the plunger 55, the diaphragm guide 60 and the valve stem assembly 29 axially away from the valve bonnet 36 until the valve disc **34*b* once again uncovers the fluid pressure inlet port 30 in the distributor plate 33. Additional fluid pressure 40 present in piping means 11 is introduced into the internal cavity 41 until the force developed by the internal pressure 41 acting against the area of the plunger 55 is greater than the combined force from the pneumatic pressure 51 acting against the diaphragm 35 and the well-bore pressure 59 acting against the well-bore pressure sensor piston assembly 39. At that point, the valve stem assembly 29, the plunger 55 and the diaphragm guide 60 move axially towards the valve bonnet 36, centering the valve disc 34*b* over the fluid pressure inlet port 30 in the distribution plate 33, once again stopping the flow of pressurized fluid 40 into the internal cavity 41. The increased internal pressure 41 is then directed to the annular blowout preventer 5 via piping means 9, increasing the well-pressure sealing pressure present in the annular closing area 54 of the annular blowout preventer 5, providing a commensurately stronger seal 58 of the inner packer element 45 to the tubular member 50**.

Figure 6:
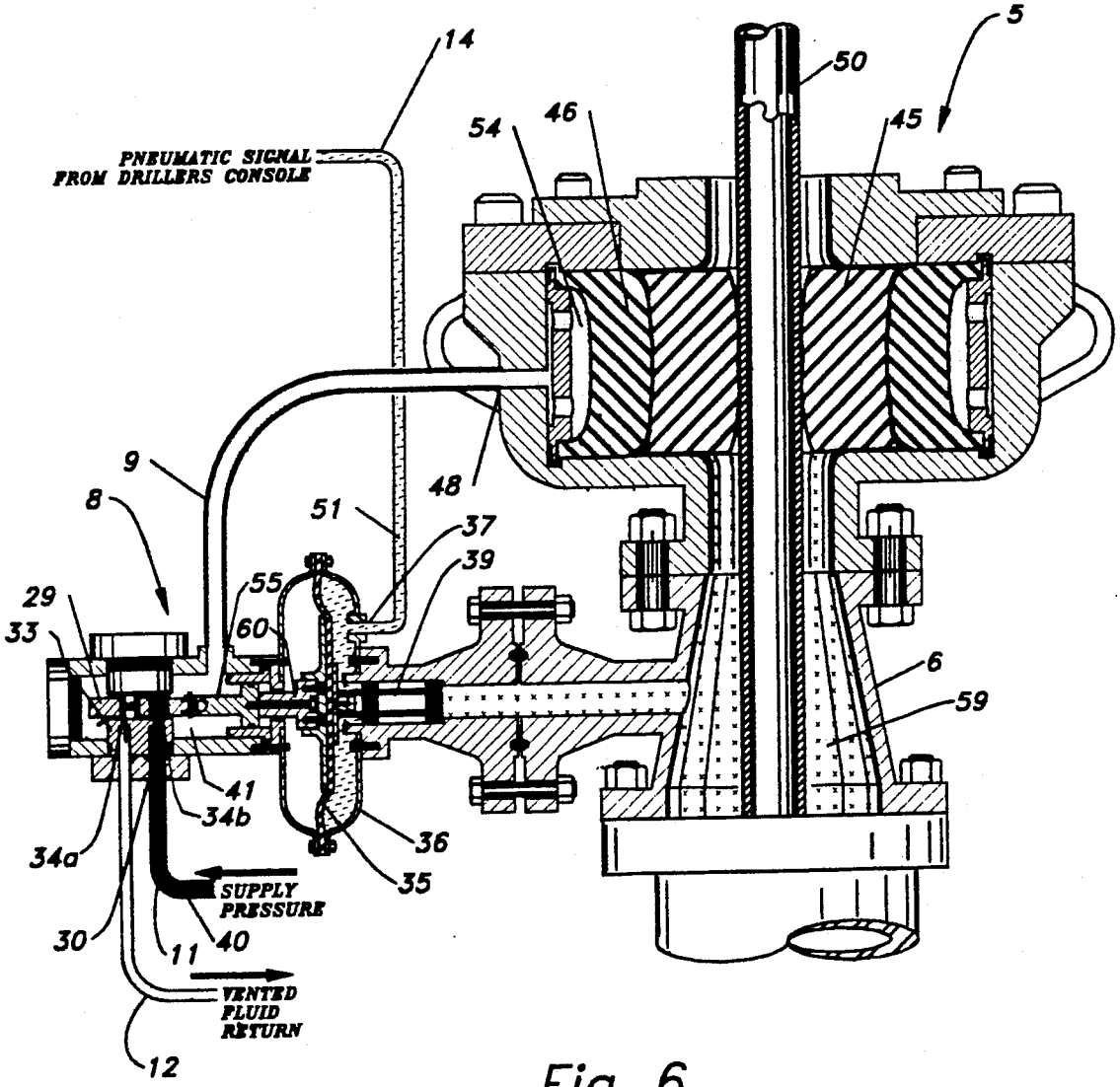

FIG. 6 illustrates a decrease in well-bore pressure 59 in the annular space between the adaptor spool and the tubular member 50. Because the force developed between the internal pressure cavity 41 and the plunger 55 is now greater than the combined force of the pneumatic pressure 51 acting against the pneumatic diaphragm 35 plus the well-bore pressure 59 acting against the well-bore pressure sensor piston assembly 39, the assembly of the valve stem 29, the plunger 55 and the diaphragm guide 60 move axially toward the valve bonnet 36. This motion moves the valve disc **34*a* from over the vent port 31 in the distributor plate 33, allowing pressurized fluid to escape to atmospheric pressure via the vented fluid return 12 and reducing the pressure contained in the internal pressure cavity 41. Once the combined force of the pneumatic pressure 51 acting on the pneumatic diaphragm 35 plus the well-bore pressure 59 acting against the well-bore pressure sensor piston assembly 39 is again greater than the force in the internal pressure cavity 41 acting against the plunger 55, the assembly consisting of the valve stem 29, the plunger 55 and the diaphragm guide 60 move axially away from the valve bonnet 36, centering the valve discs 34***a* and 34*b* over the ports in the distributor plate 33, stopping the flow of fluid into or out of the hydraulic regulator valve 8. The decrease in pressurized fluid in the internal pressure cavity 41 results in a decrease in pressure present in the annular closing area 54 of the annular blowout preventer 5, causing a reduction in well closing pressure.

Those familiar with drilling techniques will accept that this invention would also be applicable to an alternate design of an annular B.O.P., such as the one described in U.S. Pat. No. 3,533,468.

I claim:

1. A method of providing closing hydraulic pressure to an annular blowout preventer in proportion to pressure in a well bore, the method comprising the steps of: energizing a system by using pressurized fluid to create a no well-bore pressure seal; causing changes in well-bore pressure to act against a piston and valve assembly to increase or decrease the sealing pressure present in the closing area of a blowout preventer; and monitoring the actual well-bore pressure, offsetting the amount of pressure required to energize the system.

* * * * *